US007488129B1

(12) United States Patent
Prischak

(10) Patent No.: US 7,488,129 B1
(45) Date of Patent: Feb. 10, 2009

(54) SEAL FOR APPLICATOR FOR PERSONAL CARE COMPOSITIONS

(75) Inventor: Douglas J. Prischak, Erie, PA (US)

(73) Assignee: Plastek Industries, Inc., Erie, PA (US)

( * ) Notice: Subject to any disclaimer, the term of this patent is extended or adjusted under 35 U.S.C. 154(b) by 282 days.

(21) Appl. No.: 11/346,521

(22) Filed: Feb. 2, 2006

Related U.S. Application Data

(60) Provisional application No. 60/649,861, filed on Feb. 2, 2005.

(51) Int. Cl.
*B43K 23/00* (2006.01)

(52) U.S. Cl. ..... 401/98; 401/68

(58) Field of Classification Search ..... 401/68–70, 401/98, 171, 172, 174, 175
See application file for complete search history.

(56) References Cited

U.S. PATENT DOCUMENTS 5,181,790 A * 1/1993 Lucas ..... 401/75
5,727,892 A * 3/1998 Baudin ..... 401/263
5,868,510 A * 2/1999 Lacout et al. ..... 401/70
7,270,495 B1 * 9/2007 Preteroti ..... 401/175

* cited by examiner

*Primary Examiner*—Huyen Le
(74) *Attorney, Agent, or Firm*—Bachman & LaPointe, P.C.

(57) ABSTRACT

A personal care applicator apparatus seal has a structural element formed of a first material and a sealing element formed of a second material softer or less rigid than the first material. The structural element may have a sidewall with upper and lower ends and inboard and outboard surfaces. The sealing element may be molded to the structural element and may include a first portion circumscribing the sidewall.

23 Claims, 2 Drawing Sheets

SEAL FOR APPLICATOR FOR PERSONAL CARE COMPOSITIONS

CROSS-REFERENCE TO RELATED APPLICATION

Benefit is claimed of U.S. Patent Application Ser. No. 60/649,861, filed Feb. 2, 2005, and entitled "Seal for Applicator for Personal Care Compositions", the disclosure of which is incorporated by reference herein as if set forth at length.

BACKGROUND OF THE INVENTION

The invention relates to personal care. More particularly, the invention relates to applicators for underarm antiperspirant and/or deodorant.

A well-developed art exists regarding dispenser/applicators for personal care products. One particular area involves applicators for solid or gel antiperspirant and/or deodorant compositions. Applicators for solid and gel compositions are typically thoroughly similar to each other, with a piston (platform) upwardly movable within a cylinder (barrel) to progressively drive the composition out the barrel upper end. Due to the relative lack of stiffness of many gels, dispensers for such gels commonly include foraminate screen-like applicator elements across the upper end of the barrel. Many solid products, instead have a removable molded seal inserted within the upper end. In manufacture, the seal may serve to mold the composition during a bottom fill operation. At the first use of the product, the end user extracts and discards the seal exposing the upper end of the composition. As molded by the seal, the upper end may have an ergonomically or ornamentally advantageous shape.

SUMMARY OF THE INVENTION

One aspect of the invention involves a personal care applicator apparatus seal having a structural element formed of a first material and a sealing element formed of a second material softer or less rigid than the first material. The structural element may have a sidewall with upper and lower ends and inboard and outboard surfaces. The sealing element may be molded to the structural element and may include a first portion circumscribing the sidewall.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
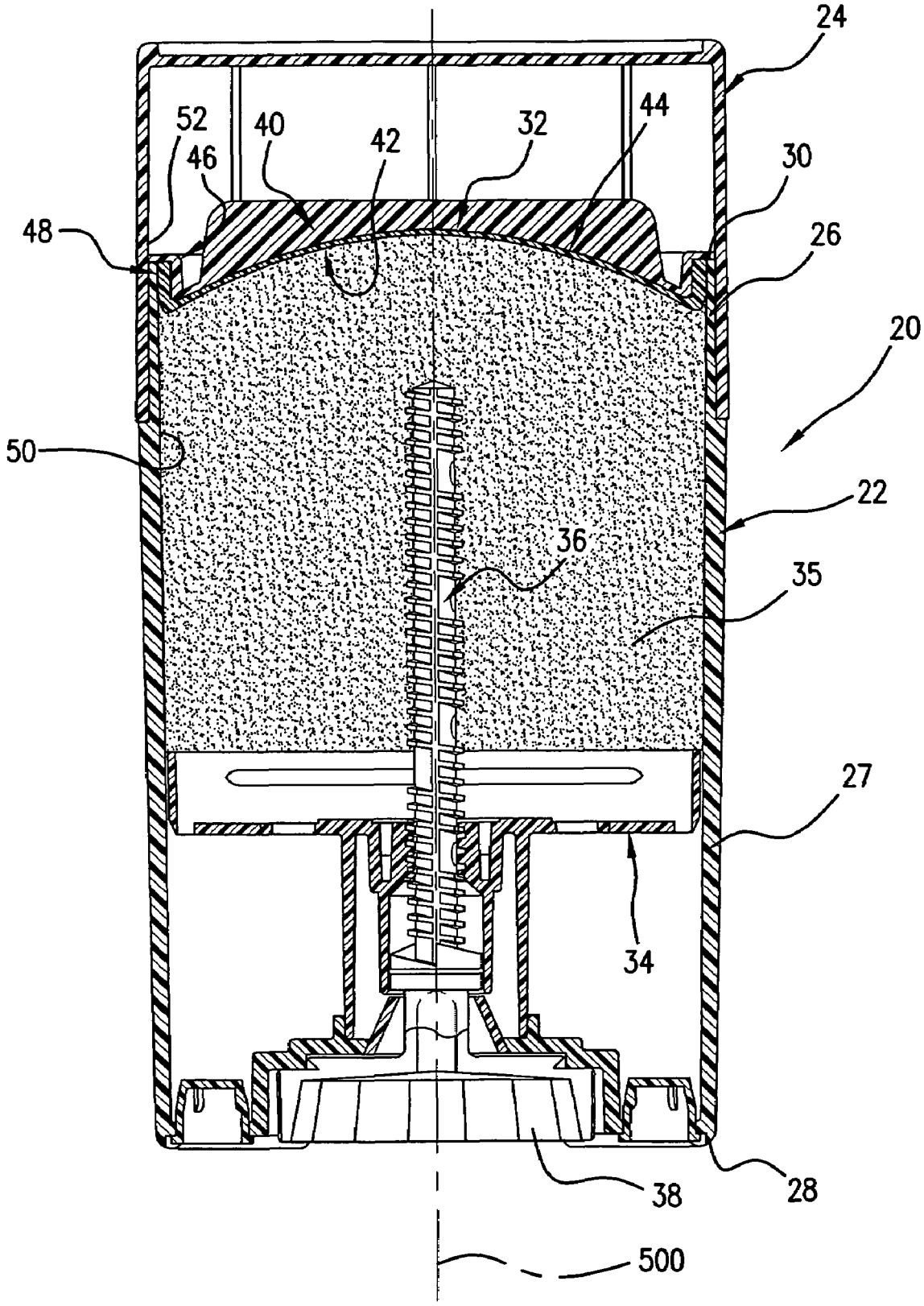
FIG. 1 is a longitudinal median cut-away view of an applicator apparatus.

FIG. 1 shows an applicator 20 having a barrel 22 and a cover 24 in an installed position on a barrel neck 26. The barrel has a sidewall 27 extending along a central longitudinal/vertical axis 500 from a bottom (base) end 28 to an upper end formed by a rim 30. A seal 32 is secured across the barrel upper end. A platform or piston 34 supports the composition 35 and is, itself, supported by an actuating mechanism 36 (e.g., a screw-type elevator mechanism) having a user-engagable element such as a knob or wheel 38. The wheel 38 may be rotated about the axis 500 for progressively raising the platform toward the barrel upper end so as to discharge the composition. The directions are relative and reference typical product orientations in shipping and display.

The seal 32 includes a dome 40 having a doubly concave lower surface or underside 42 molding a doubly convex upper surface 44 of the composition 35. The dome 40 extends upward through a sidewall 46 having an outboard surface 48 in sealing contact with the inboard/interior surface 50 of the barrel near the upper end. The seal further includes a flange 52 at the upper end of the sidewall 46 having an underside engaging the rim 30.

Figure 2:
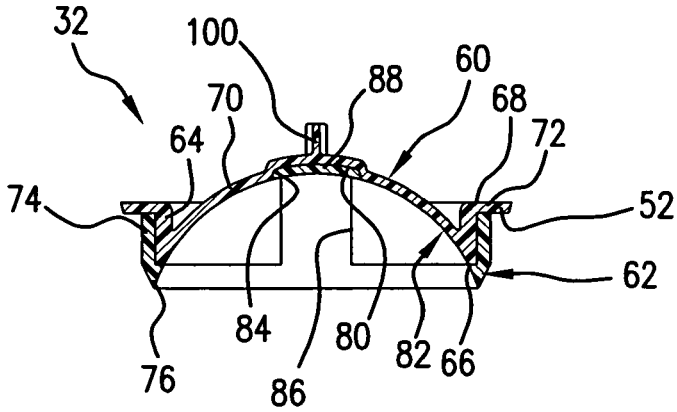
FIG. 2 is a transverse median sectional view of a seal of the apparatus of FIG. 1.

As heretofore described, the apparatus 20 may be of any of a wide variety of known or yet-developed configurations. FIG. 2, however, shows further details of the exemplary implementation of the seal 32 as a two-shot molded product. The seal includes a first element (e.g., a single piece) 60 principally serving a structural purpose and a second element (e.g., a single piece) 62 principally serving a sealing purpose. In exemplary manufacturing processes, the first piece 60 is initially molded in a first mold and then transferred to a second mold where the second piece 62 is overmolded to the first piece 60. The first piece 60 may be formed of a relatively rigid material (e.g., polypropylene). The second piece 62 may be formed of a material that is relatively soft and/or flexible and/or has a relatively high stiction property (e.g., a thermoplastic elastomer (TPE)). The softness and/or stiction of the second piece 62 provide an advantageous engagement with the barrel inboard surface 50. The compliance and stiction may help sealing and improve retention compared with a unitary seal formed from a more rigid and/or less sticky material. The first piece 60 includes a sidewall 64 having a lower end 66 and an upper end 68. A dome 70 extends upward from the lower end 66 and may extend above the upper end 68. A flange 72 extends outward from the sidewall at the upper end 68. An outboard portion of the flange 72 forms the seal flange 52.

The second piece 62 includes a first portion 74 circumscribing the sidewall 64 up to the underside of the flange 72. A second portion 76 depends from the first portion 74 and below the sidewall lower end 66. In the installed condition of FIG. 1, the outboard surface of the first portion 74 is in sealing contact with the barrel inboard surface 50 and forms an outer portion of the seal sidewall. The outboard surface of the second portion 76 may be tapered to guide insertion during installation of the seal into the barrel.

Figure 3:
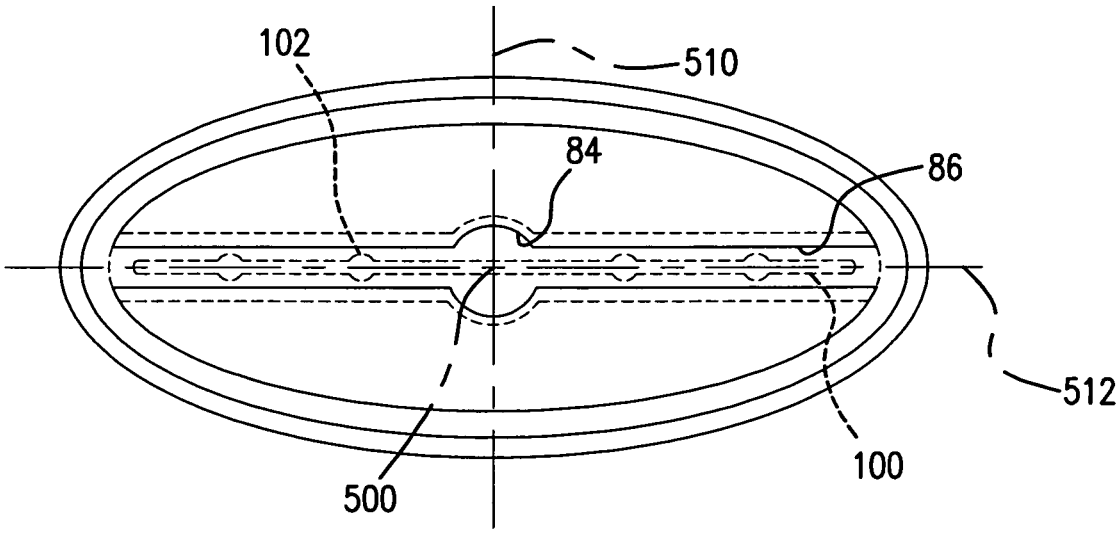
FIG. 3 is a bottom view of the seal of FIG. 2.

In the exemplary seal, the first piece 60 is molded with a channel 80 in the inboard/interior surface or underside 82 of the dome 70. FIG. 3 shows the exemplary channel 80 as having a central enlarged portion 84 (e.g., of a circular planform). A pair of narrower straight portions 86 of the channel 80 extend from the enlarged portion 84 all the way to the sidewall lower end 66. In the overmolding of the second piece 62, the overmolding fills the channel 80 with a third portion 88 of the second piece 62 spanning between opposite ends of the second portion 76. FIG. 3 shows the seal having an exemplary ellipse-like planform namely, it has symmetry across medial and transverse vertical planes 510 and 512 (or lines when viewed in section or plan), is longer along one of those two directions, and has a continuously curving concave interior. If a true ellipse, the semi-minor axis and semi-major axis would fall along the planes 510 and 512, respectively. In the exemplary implementation, the channel 80 may serve to guide a flow of the material forming the second piece 62. For example, the material may be centrally introduced within the channel portion 84 and flow outward.

In the exemplary seal, the interior surface of the second piece third portion 88 and the interior surface of the second piece second portion 76 combine with the first piece interior surface 82 to form a smooth continuously curving doubly concave surface 42 for molding a complementary doubly convex upper surface 44 of the composition.

In the exemplary seal, the first piece 60 has a structural fin 100 extending along a major portion of the length of the dome 70 and protruding from its outboard surface. The fin 100 may serve one of several functions. First, during the molding of the first piece 60, the fin may be an artifact of passageways in the mold for introducing the first material. This, for example, may leave the fin with gate artifacts 102. Additionally, the fin 100 may provide the end user with an easy grasping portion to pull and pry off the seal.

One or more embodiments of the present invention have been described. Nevertheless, it will be understood that various modifications may be made without departing from the spirit and scope of the invention. For example, the principles may be applied in a redesigning/engineering of any of a variety of existing applicators or in the design/engineering of yet new applicators. Accordingly, other embodiments are within the scope of the following claims.

What is claimed is:

1. A personal care applicator apparatus comprising:
a barrel having:
a bottom end;
a top end; and
a sidewall extending between the bottom end and the top end;
a piston upwardly moveable within the barrel from a first position to a second position;
a body of a personal care composition at least partially within the barrel between the piston and the top end;
an actuator coupled to the piston to shift the piston upward; and
a seal having:
a structural portion; and
a sealing portion of a material different from a material of the structural portion and supported by the structural portion and engaging an interior surface of the sidewall and being softer than the structural portion.

2. The apparatus of claim 1 wherein:
the body is a solid stick of at least one of an underarm antiperspirant and underarm deodorant.

3. The apparatus of claim 1 wherein:
at least at the top end, the barrel has a generally elliptical transverse cross-section.

4. The apparatus of claim 1 wherein:
the actuator comprises an elevator screw and a knob.

5. The apparatus of claim 1 further comprising:
a removable cap over the barrel upper end.

6. The apparatus of claim 1 wherein the barrel has essentially front-to-back symmetry.

7. The apparatus of claim 1 wherein the:
the sealing portion is overmolded to the structural portion.

8. The apparatus of claim 7 wherein the seal has essentially front-to-back and side-to-side symmetry.

9. The apparatus of claim 1 wherein the:
the sealing portion is overmolded to the structural portion.

10. The apparatus of claim 1 wherein:
the structural portion consists essentially of polypropylene; and
the sealing portion consists essentially of a thermoplastic elastomer.

11. A personal care applicator apparatus comprising:
a barrel having:
a bottom end;
a top end; and
a sidewall extending between the bottom end and the top end;
a piston upwardly moveable within the barrel from a first position to a second position;
a body of a personal care composition at least partially within the barrel between the piston and the top end;
an actuator coupled to the piston to shift the piston upward; and
a seal comprising:
a structural element formed of a first material and having:
a sidewall having upper and lower ends and inboard and outboard surfaces; and
a sealing element formed of a second material, less rigid than the first material, and having:
a first portion circumscribing the structural element sidewall and sealing with the barrel.

12. The apparatus of claim 11 wherein:
the structural element has:
a flange extending laterally outward from the sidewall upper end;
a dome extending upward laterally within the sidewall; and
a channel along an interior surface of the dome; and
the sealing element has:
a second portion below the first portion and below the structural element sidewall lower end; and
a third portion extending within the channel and joining the second portion.

13. The apparatus of claim 11 further comprising:
the structural element consists essentially of polypropylene; and
the sealing element consists essentially of a thermoplastic elastomer.

14. The apparatus of claim 11 wherein the sidewall has essentially front-to-back and side-to-side symmetry and an ellipse-like planform.

15. A method for manufacturing a personal care applicator, comprising:
manufacturing a seal, comprising:
molding a structural element of a first material; and
overmolding a sealing element to the structural element, the sealing element comprising a second material less rigid than the first material;
assembling the seal with a barrel, a piston, and actuator and a body of a personal care composition:
the barrel having:
a bottom end;
a top end; and
a sidewall extending between the bottom end and the top end and sealing with the sealing element;
the piston upwardly moveable within the barrel from a first position to a second position;
the body of the personal care composition at least partially within the barrel between the piston and the top end; and
the actuator coupled to the piston to shift the piston upward.

16. The method of claim 15 wherein:
the molding forms the structural element with:
a sidewall having upper and lower ends and inboard and outboard surfaces;

a flange extending laterally outward from the structural element sidewall upper end; and a dome extending upward laterally within the structural element sidewall; and the overmolding forms the sealing element with a first portion circumscribing the structural element sidewall.

17. The method of claim 16 wherein:

the molding forms the structural element with:

a channel along an interior surface of the dome; and a fin along an exterior surface of the dome; and the overmolding forms the sealing element with:

a second portion below the first portion and below the structural element sidewall lower end; and a third portion extending within the channel and joining the second portion.

18. The method of claim 17 wherein:

the molding forms the structural element as a single piece; and the overmolding forms the sealing element as a single piece.

19. A personal care applicator apparatus seal comprising:

a structural element formed of a first material and having:

a sidewall having upper and lower ends and inboard and outboard surfaces;

a flange extending laterally outward from the sidewall upper end;

a dome extending upward laterally within the sidewall; and a channel along an interior surface of the dome and a sealing element formed of a second material, less rigid than the first material, and having:

a first portion circumscribing the structural element sidewall;

a second portion below the first portion and below the structural element sidewall lower end; and a third portion extending within the channel and joining the second portion.

20. The seal of claim 19 wherein:

the sealing element is overmolded to the structural element;

the structural element consists essentially of polypropylene; and the sealing element consists essentially of a thermoplastic elastomer.

21. A method for manufacturing a seal for a personal care applicator, comprising:

molding a structural element of a first material, the molding forming the structural element as a single piece with:

a sidewall having upper and lower ends and inboard and outboard surfaces;

a flange extending laterally outward from the structural element sidewall upper end; and a dome extending upward laterally within the structural element sidewall; and overmolding a sealing element to the structural element, the sealing element comprising a second material less rigid than the first material, the overmolding forming the sealing element as a single piece with a first portion circumscribing the structural element sidewall.

22. The method of claim 21 wherein:

the molding forms the structural element with:

a channel along an interior surface of the dome; and a fin along an exterior surface of the dome; and the overmolding forms the sealing element with:

a second portion below the first portion and below the structural element sidewall lower end; and a third portion extending within the channel and joining the second portion.

23. A method for manufacturing a seal for a personal care applicator, comprising:

molding a structural element of a first material, the molding forming the structural element with:

a sidewall having upper and lower ends and inboard and outboard surfaces;

a flange extending laterally outward from the structural element sidewall upper end;

a dome extending upward laterally within the structural element sidewall;

a channel along an interior surface of the dome; and a fin along an exterior surface of the dome; and overmolding a sealing element to the structural element, the sealing element comprising a second material less rigid than the first material, the overmolding forming the sealing element with:

a first portion circumscribing the structural element sidewall;

a second portion below the first portion and below the structural element sidewall lower end; and a third portion extending within the channel and joining the second portion.

* * * * *